US008858189B2

(12) United States Patent
Wang

(10) Patent No.: US 8,858,189 B2
(45) Date of Patent: Oct. 14, 2014

(54) PUMPING DEVICE FOR SUCKING OR DRAINING FLUID

(76) Inventor: Kun-Wang Wang, Tainan (TW)

( * ) Notice: Subject to any disclaimer, the term of this patent is extended or adjusted under 35 U.S.C. 154(b) by 550 days.

(21) Appl. No.: 13/271,332

(22) Filed: Oct. 12, 2011

(65) Prior Publication Data

US 2013/0092262 A1 Apr. 18, 2013

(51) Int. Cl.

| | |
|---|---|
| ***F04B 9/14*** | (2006.01) |
| ***F04F 1/06*** | (2006.01) |
| ***F04B 53/12*** | (2006.01) |
| ***F04B 23/02*** | (2006.01) |

(52) U.S. Cl.

CPC ..... *F04B 9/14* (2013.01); *F04B 23/021* (2013.01); *F04B 23/028* (2013.01)

USPC ..... 417/118; 417/374; 417/545

(58) Field of Classification Search

USPC ..... 417/374, 437, 442, 448, 455, 514, 495, 417/523, 545, 552, 555.1; 137/512; 222/402

See application file for complete search history.

(56) References Cited

U.S. PATENT DOCUMENTS

| | | | | |
|---|---|---|---|---|
| 6,814,264 | B2 * | 11/2004 | Chen | 222/402 |
| 7,093,624 | B2 * | 8/2006 | Chen | 141/65 |
| 8,240,433 | B2 * | 8/2012 | Tseng | 184/1.5 |
| 8,419,376 | B2 * | 4/2013 | Sun | 417/118 |
| 8,419,377 | B2 * | 4/2013 | Hsu | 417/118 |

* cited by examiner

*Primary Examiner* — Nathan Zollinger

(74) *Attorney, Agent, or Firm* — Alan Kamrath; Kamrath IP Lawfirm, P.A.

(57) ABSTRACT

A pumping device includes a barrel (1), a top cover (2), a switching valve (3), a cylinder (4), a piston (53), a connecting unit (6), an operation unit (5), a delivery unit (7), a pressure gauge (8), and a pressure release unit (9). Thus, the user has to pull or push the switching valve to extract or suck the air in the barrel so as to deflate or inflate the barrel so that the pumping device has a security process and is operated in a safer manner. In addition, the flow of the fluid is proceeded in the barrel so that the pumping device is operated smoothly and conveniently.

8 Claims, 9 Drawing Sheets

PUMPING DEVICE FOR SUCKING OR DRAINING FLUID

BACKGROUND OF THE INVENTION

1. Field of the Invention

The present invention relates to a pumping device and, more particularly, to a pumping device for pumping a fluid, including gas and liquid.

2. Description of the Related Art

A conventional pumping device comprises a barrel, a top cover mounted on the top of the barrel, a cylinder mounted in the barrel, a piston movably mounted in the cylinder, and an operation unit mounted on the top cover and connected with the piston to move the piston relative to the cylinder. Thus, the piston is driven by the operation unit to pump a fluid into the cylinder and the barrel. However, a user can directly control the operation unit to operate the pumping device so that the pumping device does not have a security mechanism limit the operation unit to prevent the user from operating the pumping device improperly.

BRIEF SUMMARY OF THE INVENTION

In accordance with the present invention, there is provided a pumping device, comprising pumping device, comprising a barrel, a top cover mounted on a top of the barrel, a tap removably mounted on an open top of the top cover, a switching valve mounted on the top cover to control connection between the barrel and the top cover, a cylinder mounted in the barrel and connected to the top cover, a piston movably mounted in the cylinder, a plurality of check valves mounted on the piston, a connecting unit mounted on the barrel and connected between the top cover and the cylinder, an operation unit mounted on the top cover and connected with the piston, and a delivery unit mounted on the top cover and connected to the barrel.

The barrel has an interior provided with a receiving chamber. The top cover has an interior provided with a flow channel and has a central portion provided with a shaft hole connected between the flow channel and the cylinder. The flow channel of the top cover has an upper portion provided with a drain hole connected to an ambient environment through the top cover. The flow channel of the top cover has a lower portion provided with a first connecting hole connected between the flow channel and the connecting unit and a second connecting hole connected between the flow channel and the receiving chamber of the barrel. The switching valve is mounted on the flow channel of the top cover and includes a valve stem movably mounted in the flow channel of the top cover, a plurality of gaskets mounted on the valve stem and a plurality of connecting grooves formed between the gaskets. The valve stem of the switching valve has an interior provided with a through hole connected between the flow channel of the top cover and the connecting grooves. The connecting grooves of the switching valve are connected to the drain hole, the first connecting hole and the second connecting hole of the top cover respectively. The cylinder is received in the receiving chamber of the barrel and has an interior provided with a piston chamber connected between the shaft hole of the top cover and the connecting unit. The operation unit includes a propeller shaft movably mounted in the piston chamber of the cylinder and connected with the piston to move the piston. The connecting unit includes a tube connected with the cylinder and having a connecting port connected to the piston chamber of the cylinder, and a conduit having a lower end connected to the tube and an upper end connected to the top cover.

The primary objective of the present invention is to provide a pumping device that is operated easily and safely.

According to the primary advantage of the present invention, the user has to pull or push the switching valve to extract or suck the air in the barrel so as to deflate or inflate the receiving chamber of the barrel so that the pumping device has a security process and is operated in a safer manner.

According to another advantage of the present invention, the liquid in the receiving chamber of the barrel is compressed gradually by the air pressure to flow through the pipe of the delivery unit into an external container completely so that the receiving chamber of the barrel can be kept clean without containing impurities.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
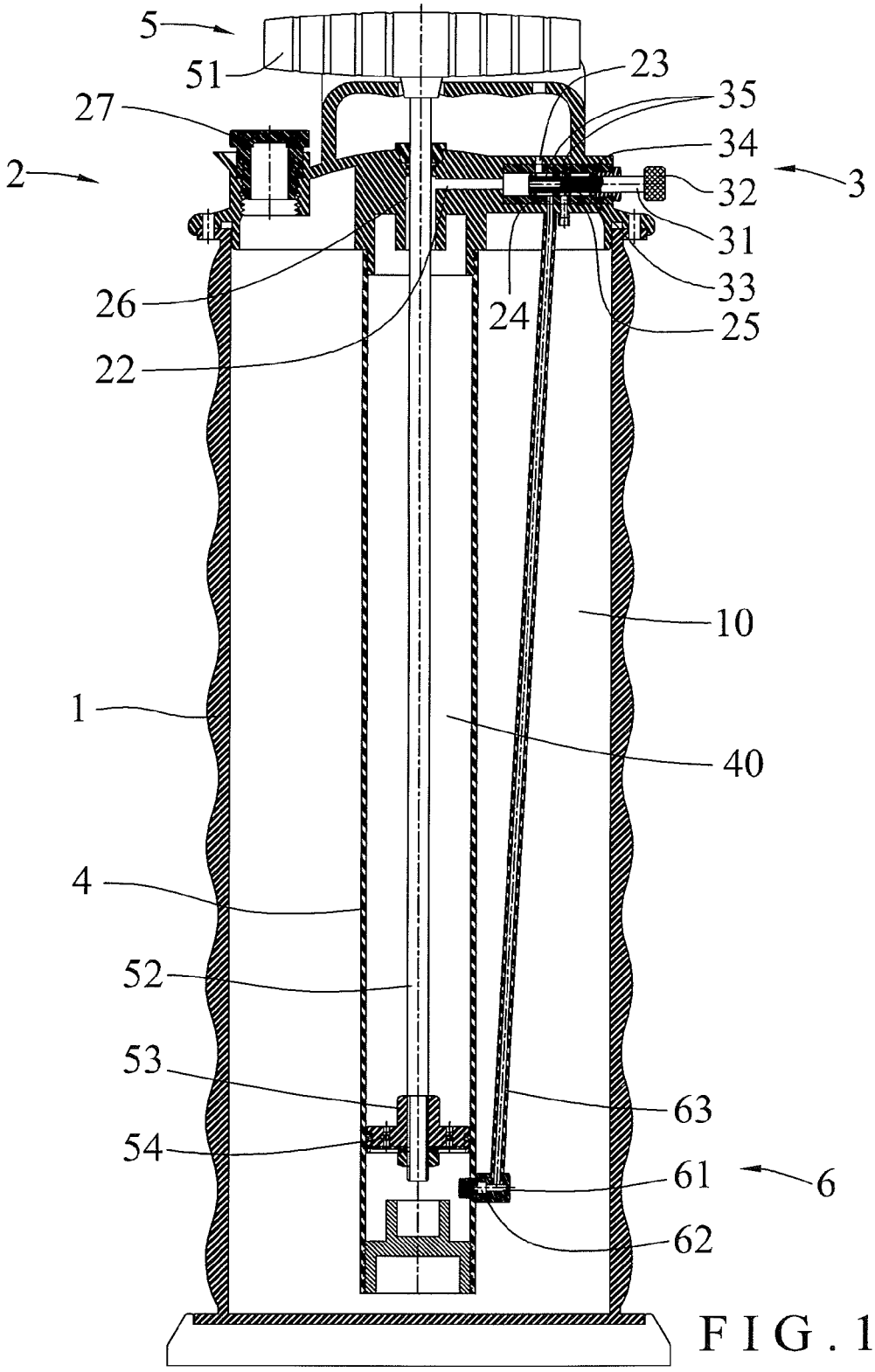
FIG. 1 is a front cross-sectional view of a pumping device in accordance with the preferred embodiment of the present invention.

Referring to the drawings and initially to FIGS. 1-8, a pumping device in accordance with the preferred embodiment of the present invention comprises a barrel 1, a top cover 2 mounted on a top of the barrel 1, a tap 27 removably mounted on an open top of the top cover 2, a switching valve 3 mounted on the top cover 2 to control connection between the barrel 1 and the top cover 2, a cylinder 4 mounted in the barrel 1 and connected to the top cover 2, a piston 53 movably mounted in the cylinder 4, a plurality of check valves 54 mounted on the piston 53 to move in concert with the piston 53, a connecting unit 6 mounted on the barrel 1 and connected between the top cover 2 and the cylinder 4, an operation unit 5 mounted on the top cover 2 and connected with the piston 53 to move the piston 53 relative to the cylinder 4, a delivery unit 7 mounted on the top cover 2 and connected to the barrel 1, a pressure gauge 8 mounted on the top cover 2 and connected to the barrel 1, and a pressure release unit 9 mounted on the top cover 2 and connected to the barrel 1.

The barrel 1 has an interior provided with a receiving chamber 10 to receive the cylinder 4 and the connecting unit 6.

The top cover 2 has an interior provided with a flow channel 22 and has a central portion provided with a shaft hole 26 connected between the flow channel 22 and the cylinder 4. The flow channel 22 of the top cover 2 has an upper portion provided with a drain hole 23 connected to an ambient environment through the top cover 2. The flow channel 22 of the top cover 2 has a lower portion provided with a first connecting hole 24 connected between the flow channel 22 and the connecting unit 6 and a second connecting hole 25 connected between the flow channel 22 and the receiving chamber 10 of the barrel 1.

The switching valve 3 is mounted on the flow channel 22 of the top cover 2 and includes a valve stem 32 movably mounted in the flow channel 22 of the top cover 2, a plurality of gaskets 34 mounted on the valve stem 32 and a plurality of connecting grooves 35 formed between the gaskets 34. The valve stem 32 of the switching valve 3 has an interior provided with a through hole 33 connected between the flow channel 22 of the top cover 2 and the connecting grooves 35. The connecting grooves 35 of the switching valve 3 are connected to the drain hole 23, the first connecting hole 24 and the second connecting hole 25 of the top cover 2 respectively. Thus, the fluid can flow through the connecting grooves 35 of the switching valve 3, the through hole 33 of the switching valve 3, the flow channel 22 of the top cover 2 and the shaft hole 26 of the top cover 2 into the cylinder 4. The valve stem 32 of the switching valve 3 has a distal end provided with a drive portion 31 protruding outward from the flow channel 22 of the top cover 2.

Figure 2:
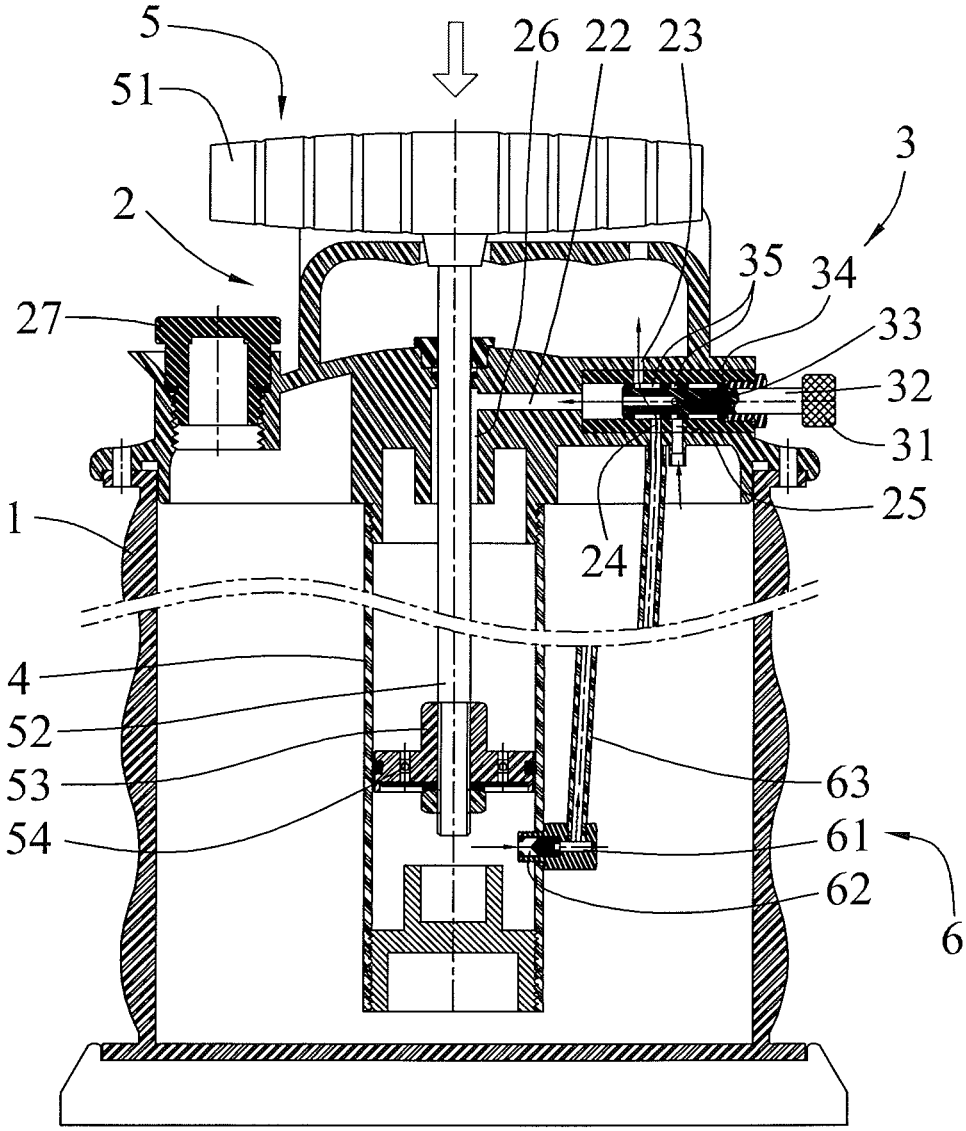
FIG. 2 is a partially enlarged operational view of the pumping device as shown in FIG. 1 in use.
Figure 3:
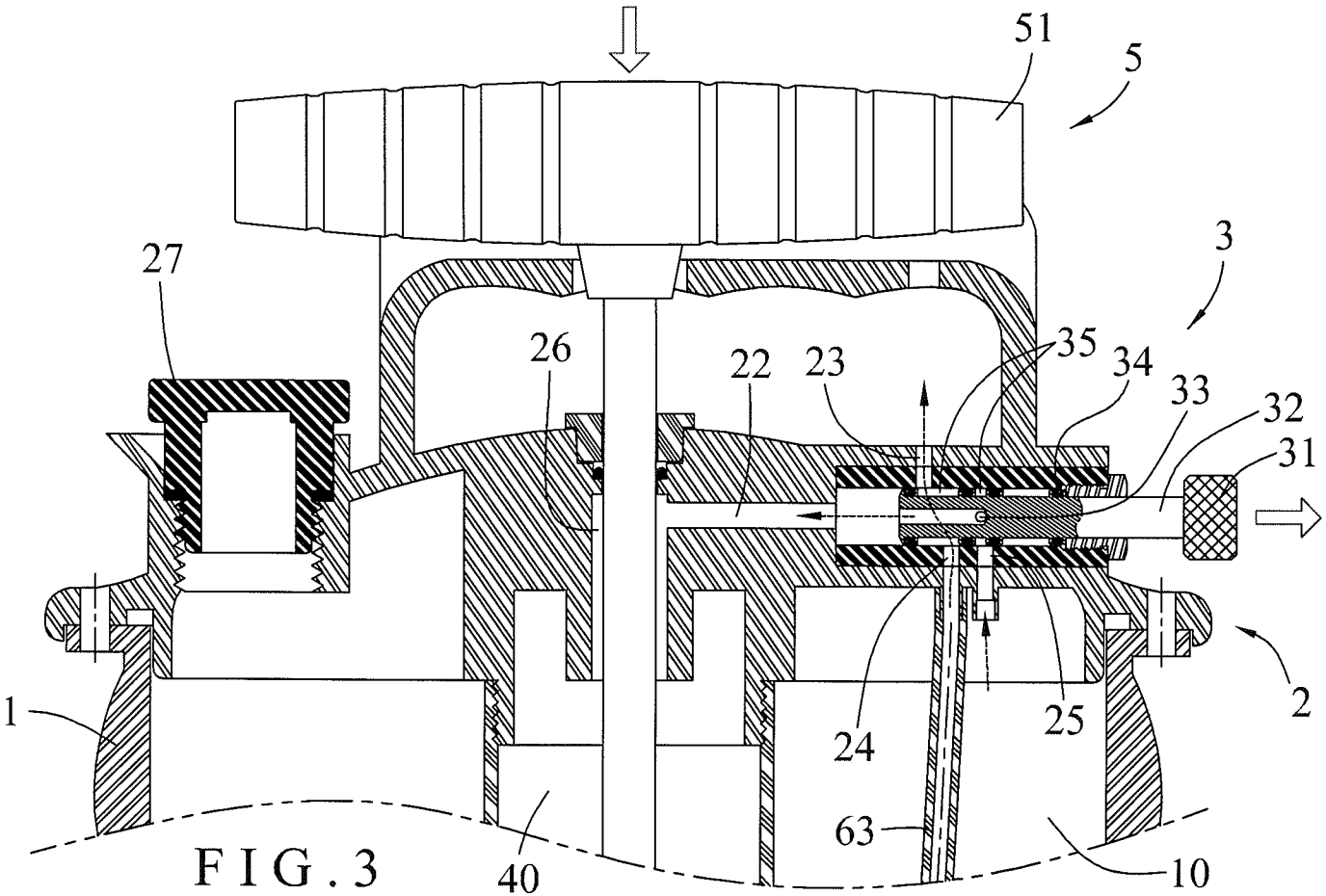
FIG. 3 is a locally enlarged view of the pumping device as shown in FIG. 2.
Figure 6:
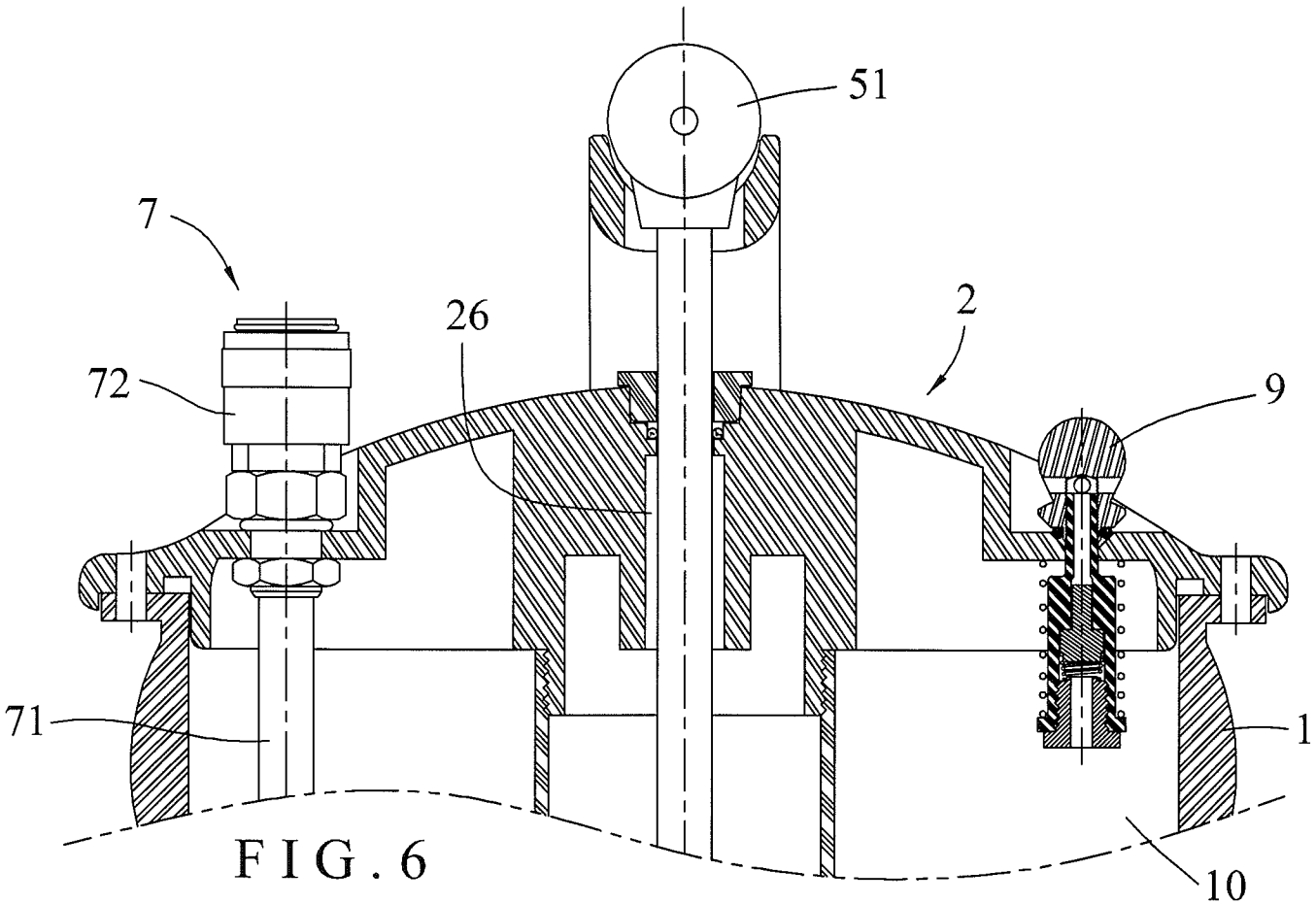
FIG. 6 is a locally enlarged view of the pumping device as shown in FIG. 4.
Figure 7:
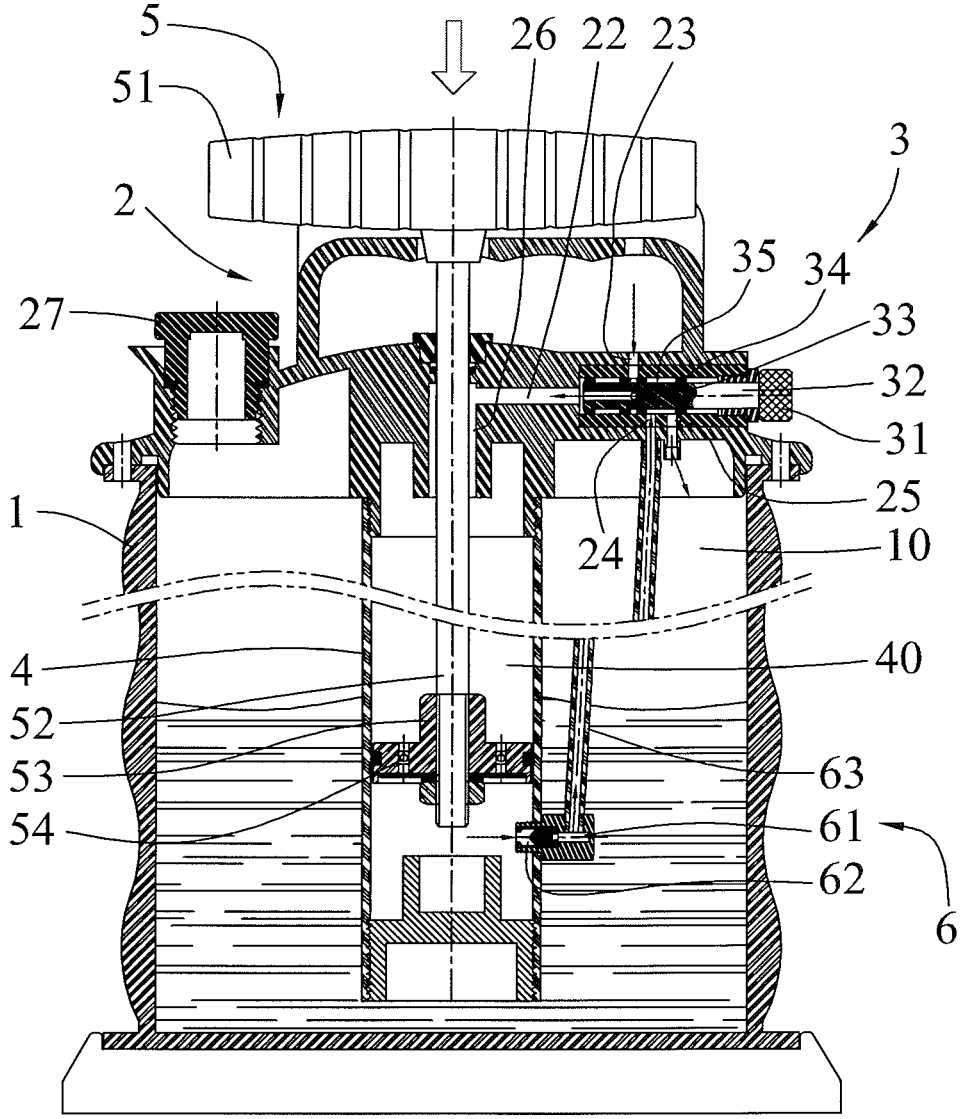
FIG. 7 is a partially enlarged operational view of the pumping device as shown in FIG. 1 in use.

In practice, when the valve stem 32 of the switching valve 3 is pulled outward from the flow channel 22 of the top cover 2 as shown in FIGS. 2 and 3, the first connecting hole 24 of the top cover 2 is connected to the drain hole 23 of the top cover 2 through the connecting grooves 35 of the switching valve 3, and the second connecting hole 25 of the top cover 2 is connected to the flow channel 22 of the top cover 2 through the connecting grooves 35 and the through hole 33 of the switching valve 3. On the contrary, when the valve stem 32 of the switching valve 3 is pushed into the flow channel 22 of the top cover 2 as shown in FIGS. 6 and 7, the drain hole 23 of the top cover 2 is connected to the flow channel 22 of the top cover 2 through the connecting grooves 35 and the through hole 33 of the switching valve 3, and the first connecting hole 24 of the top cover 2 is connected to the second connecting hole 25 of the top cover 2 through the connecting grooves 35.

The cylinder 4 is received in the receiving chamber 10 of the barrel 1 and has an interior provided with a piston chamber 40 connected between the shaft hole 26 of the top cover 2 and the connecting unit 6. The piston chamber 40 of the cylinder 4 has an upper end connected to the flow channel 22 of the top cover 2 through the shaft hole 26 and has a lower end connected to the connecting unit 6.

The piston 53 is movable in the piston chamber 40 of the cylinder 4 and is limited between the top cover 2 and a bottom of the cylinder 4. The check valves 54 are received in the piston chamber 40 of the cylinder 4. Each of the check valves 54 only allows the fluid in the piston chamber 40 of the cylinder 4 to flow from up to down.

The operation unit 5 includes a propeller shaft 52 movably mounted in the piston chamber 40 of the cylinder 4 and having a lower end connected with the piston 53 to move the piston 53 and an upper end protruding outward from the top cover 2, and a grip portion 51 mounted on the upper end of the propeller shaft 52 to move the propeller shaft 52 relative to the cylinder 4. The propeller shaft 52 of the operation unit 5 extends through the shaft hole 26 of the top cover 2.

The connecting unit 6 includes a tube 61 connected with the cylinder 4 and having a connecting port 62 connected to the piston chamber 40 of the cylinder 4, and a conduit 63 having a lower end connected to the tube 61 and an upper end connected to the top cover 2. The conduit 63 of the connecting unit 6 is connected to the first connecting hole 24 of the top cover 2. The connecting port 62 of the tube 61 is a oneway channel.

The delivery unit 7 includes a pipe 71 mounted in the receiving chamber 10 of the barrel 1 and having a lower end extended to a bottom of the barrel 1 and an upper end attached to the top cover 2, and a connector 72 mounted on the top cover 2 and connected to the upper end of the pipe 71. The connector 72 of the delivery unit 7 protrudes outward from the top cover 2 and is externally connected to a container (not shown).

The pressure release unit 9 is connected to the receiving chamber 10 of the barrel 1. The pressure release unit 9 has an upper end attached to the top cover 2 and a lower end connected to the receiving chamber 10 of the barrel 1.

In operation, when the valve stem 32 of the switching valve 3 is pulled outward relative to the top cover 2 as shown in FIGS. 2 and 3, the first connecting hole 24 of the top cover 2 is connected to the drain hole 23 of the top cover 2 through the connecting grooves 35 of the switching valve 3, and the second connecting hole 25 of the top cover 2 is connected to the flow channel 22 of the top cover 2 through the connecting grooves 35 and the through hole 33 of the switching valve 3. In such a manner, when the piston 53 is moved upward in the piston chamber 40 of the cylinder 4 by pulling the grip portion 51 of the operation unit 5, the piston chamber 40 of the cylinder 4 under the piston 53 is evacuated to form a vacuum suction force, so that the air in the receiving chamber 10 of the barrel 1 is drawn by the vacuum suction force to flow through the second connecting hole 25 of the top cover 2, the connecting grooves 35 of the switching valve 3, the through hole 33 of the switching valve 3, the flow channel 22 of the top cover 2 and the shaft hole 26 of the top cover 2 into the piston chamber 40 of the cylinder 4. Then, the air passes through the check valves 54 into the piston chamber 40 of the cylinder 4 under the piston 53. Then, when the piston 53 is moved downward in the piston chamber 40 of the cylinder 4 by pushing the grip portion 51 of the operation unit 5, the air in the piston chamber 40 of the cylinder 4 is compressed by the piston 53 to flow through the connecting port 62 of the tube 61, the conduit 63 of the connecting unit 6, the first connecting hole 24 of the top cover 2 and the drain hole 23 of the top cover 2 and is drained outward from the top cover 2 into the ambient environment. Thus, when the piston 53 is moved upward and downward in the piston chamber 40 of the cylinder 4 in a reciprocal manner, the air in the receiving chamber 10 of the barrel 1 is drained successively so that the receiving chamber 10 of the barrel 1 is evacuated gradually to form a vacuum state. At this time, when the connector 72 of the delivery unit 7 is externally connected to a container, the liquid in the container is sucked and drawn successively into the receiving chamber 10 of the barrel 1 by the vacuum suction force in the receiving chamber 10 of the barrel 1.

When the user wishes to draw the liquid out of the barrel 1, the tap 27 is removed from the open top of the top cover 2 so that the liquid in the receiving chamber 10 of the barrel 1 can be dumped or drained outward from the open top of the top cover 2.

Figure 4:
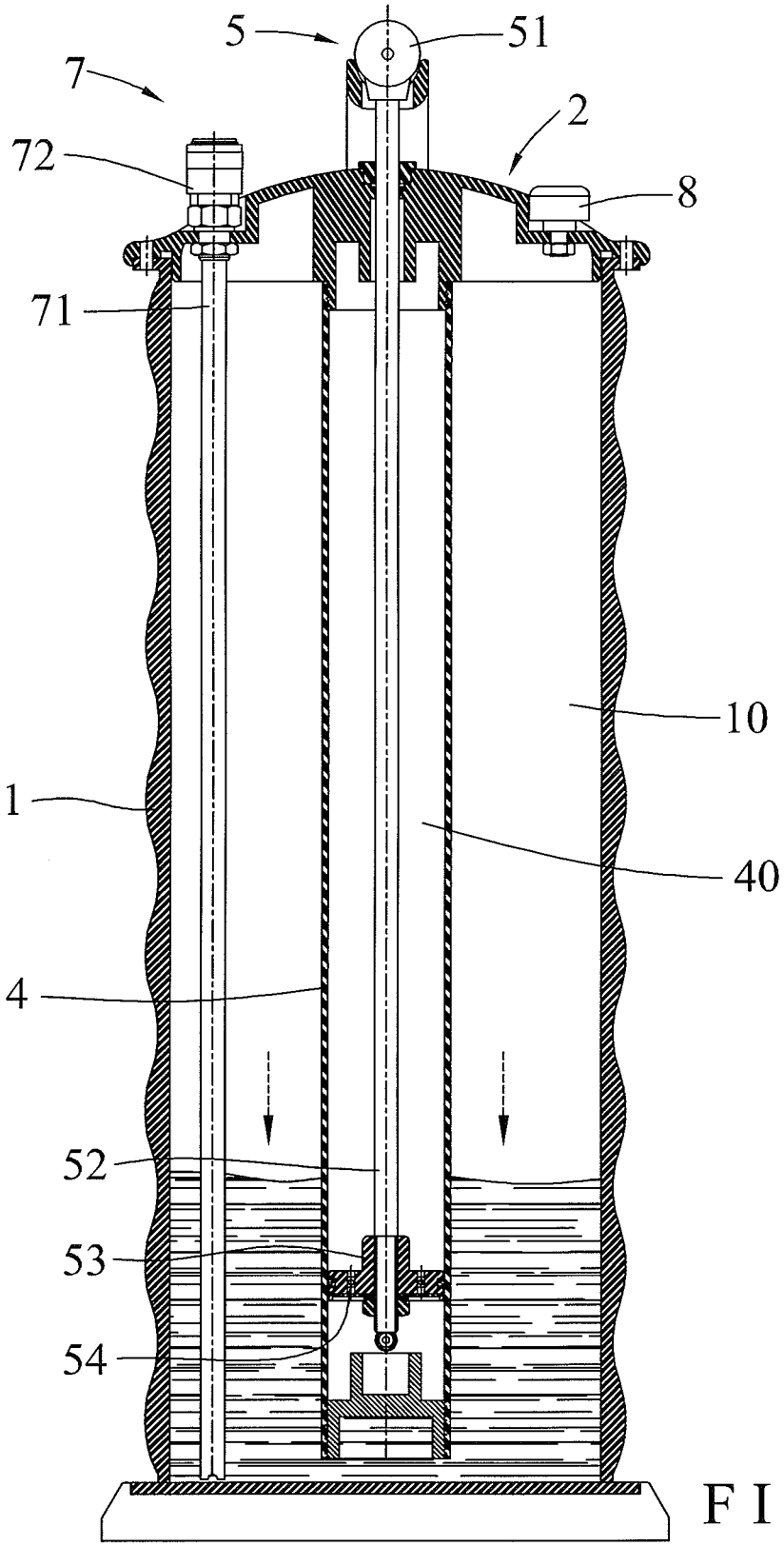
FIG. 4 is a side cross-sectional view of the pumping device in accordance with the preferred embodiment of the present invention.
Figure 8:
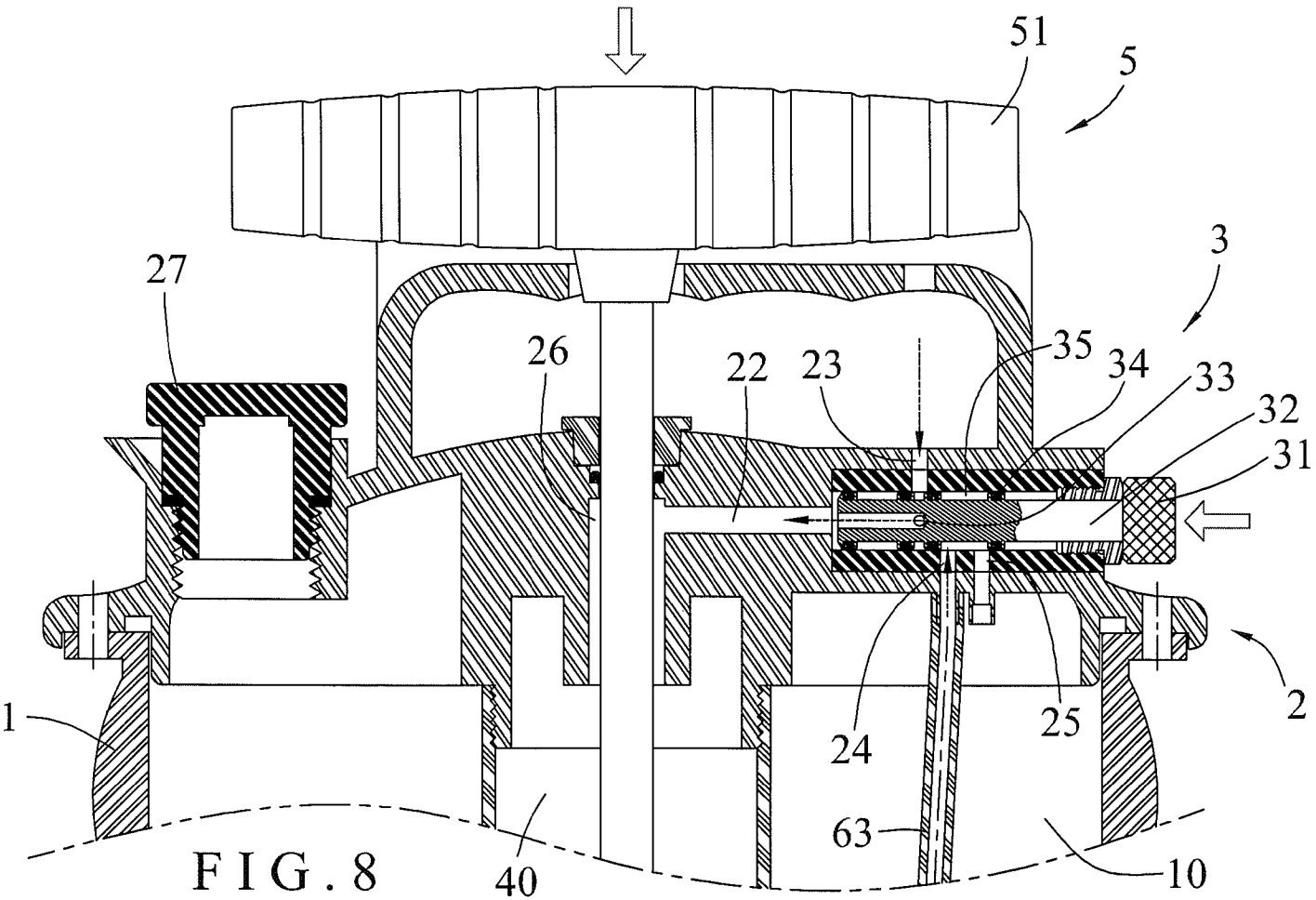
FIG. 8 is a locally enlarged view of the pumping device as shown in FIG. 7.

On the contrary, when the valve stem 32 of the switching valve 3 is pushed into the flow channel 22 of the top cover 2 as shown in FIGS. 7 and 8, the drain hole 23 of the top cover 2 is connected to the flow channel 22 of the top cover 2 through the connecting grooves 35 and the through hole 33 of the switching valve 3, and the first connecting hole 24 of the top cover 2 is connected to the second connecting hole 25 of the top cover 2 through the connecting grooves 35. In such a manner, when the piston 53 is moved downward in the piston chamber 40 of the cylinder 4 by pushing the grip portion 51 of the operation unit 5, the air in the piston chamber 40 of the cylinder 4 is compressed by the piston 53 to flow through the connecting port 62 of the tube 61, the conduit 63 of the connecting unit 6, the first connecting hole 24 of the top cover 2, the connecting grooves 35 of the switching valve 3 and the second connecting hole 25 of the top cover 2 into the receiving chamber 10 of the barrel 1 to compress the liquid in the receiving chamber 10 of the barrel 1 as shown in FIG. 7. At the same time, when the piston 53 is moved downward in the piston chamber 40 of the cylinder 4, the piston chamber 40 of the cylinder 4 above the piston 53 forms a suction force so that the air in the ambient environment is drawn to pass through the drain hole 23 of the top cover 2, the connecting grooves 35 of the switching valve 3, and the through hole 33 of the switching valve 3 into the flow channel 22 of the top cover 2. Then, the air in the flow channel 22 of the top cover 2 flows through the shaft hole 26 of the top cover 2 into the piston chamber 40 of the cylinder 4. Then, when the piston 53 is moved upward in the piston chamber 40 of the cylinder 4 by pulling the grip portion 51 of the operation unit 5, the air passes through the check valves 54 into the piston chamber 40 of the cylinder 4 under the piston 53. Thus, when the piston 53 is moved upward and downward in the piston chamber 40 of the cylinder 4 in a reciprocal manner, the air in the ambient environment is sucked and drawn successively into the receiving chamber 10 of the barrel 1 to compress the liquid in the receiving chamber 10 of the barrel 1 as shown in FIG. 4 so that the liquid in the receiving chamber 10 of the barrel 1 is compressed gradually to flow through the pipe 71 and the connector 72 of the delivery unit 7 and is delivered to the container.

Figure 5:
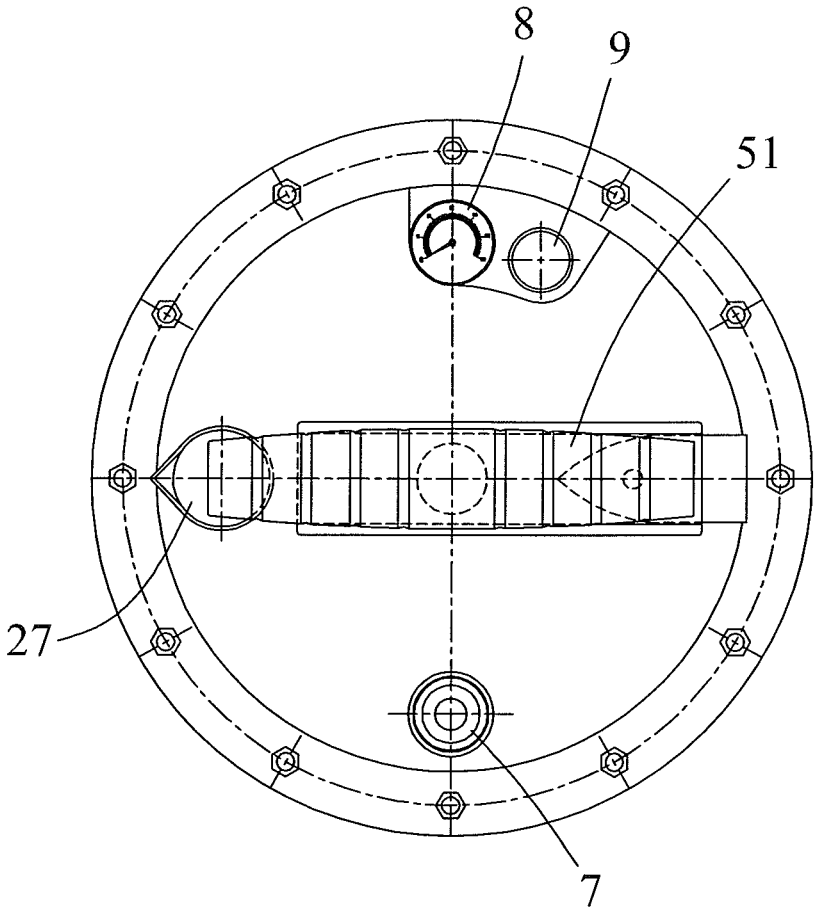
FIG. 5 is a top view of the pumping device in accordance with the preferred embodiment of the present invention.

As shown in FIG. 5, the pressure gauge 8 can indicate the air pressure in the receiving chamber 10 of the barrel 1.

As shown in FIG. 6, when the air pressure in the receiving chamber 10 of the barrel 1 exceeds a predetermined value, the pressure release unit 9 is pushed upward to connect the receiving chamber 10 of the barrel 1 to the ambient environment so that the air in the receiving chamber 10 of the barrel 1 is partially drained outward from the top cover 2 to achieve a pressure release function.

Figure 9:
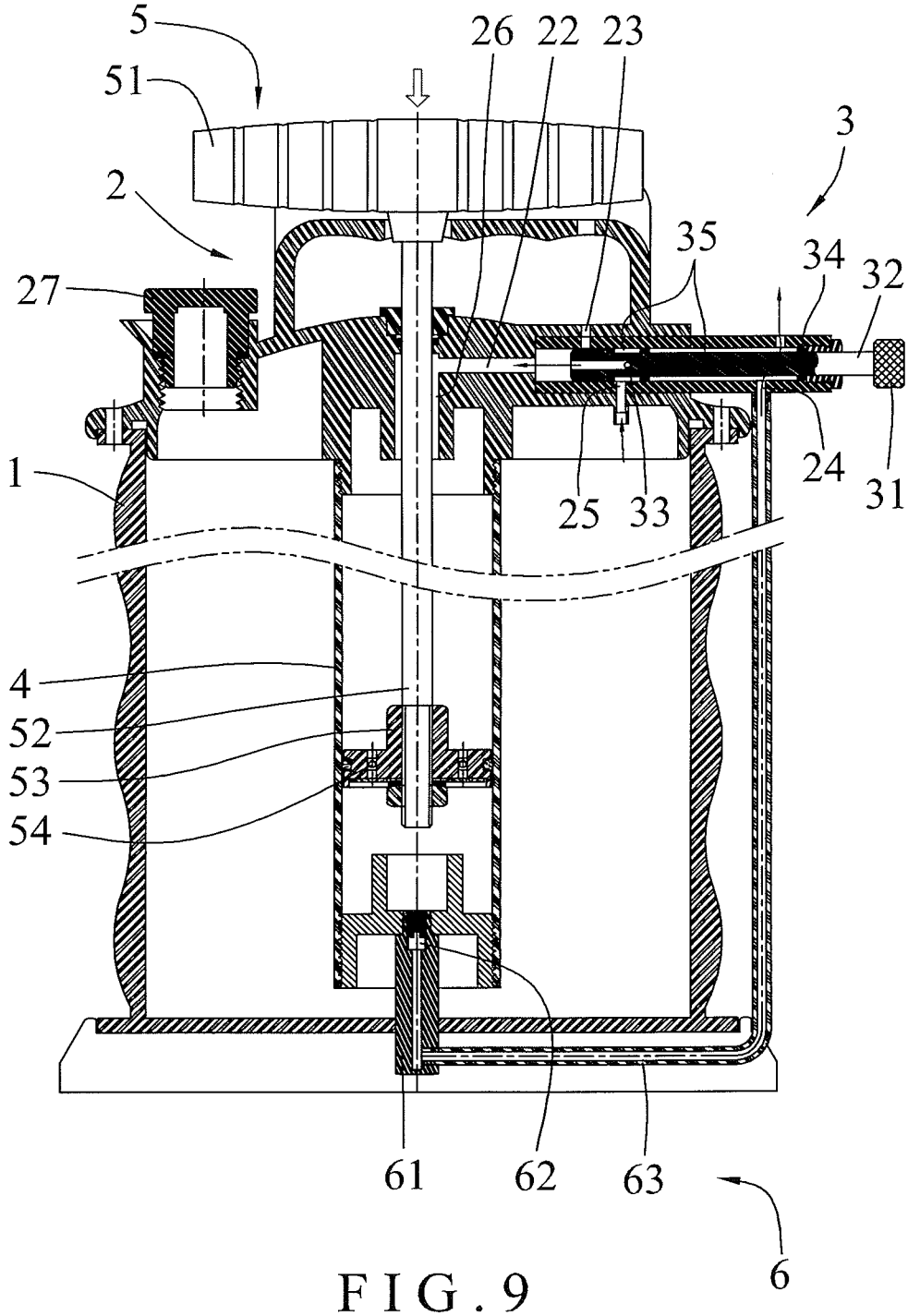
FIG. 9 is a front cross-sectional view of a pumping device in accordance with another preferred embodiment of the present invention.

As shown in FIG. 9, the tube 61 of the connecting unit 6 is extended through the bottom of the barrel 1 and is connected with the bottom of the cylinder 4. The conduit 63 of the connecting unit 6 is located outside of the barrel 1 and is connected to the first connecting hole 24 of the top cover 2.

Accordingly, the user has to pull or push the switching valve 3 to extract or suck the air in the barrel 1 so as to deflate or inflate the receiving chamber 10 of the barrel 1 so that the pumping device has a security process and is operated in a safer manner. In addition, the liquid in the receiving chamber 10 of the barrel 1 is compressed gradually by the air pressure to flow through the pipe 71 of the delivery unit 7 into an external container completely so that the receiving chamber 10 of the barrel 1 can be kept clean without containing impurities. Further, the pressure gauge 8 can indicate the air pressure in the receiving chamber 10 of the barrel 1, and when the air pressure in the receiving chamber 10 of the barrel 1 exceeds a predetermined value, the pressure release unit 9 can provide a pressure release function to ensure safe operation of the pumping device. Further, the flow of the fluid is proceeded in the barrel 1 so that the pumping device is operated smoothly and conveniently.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A pumping device, comprising:

a barrel;

a top cover mounted on a top of the barrel;

a tap removably mounted on an open top of the top cover;

a switching valve mounted on the top cover to control connection between the barrel and the top cover;

a cylinder mounted in the barrel and connected to the top cover;

a piston movably mounted in the cylinder;

a plurality of check valves mounted on the piston;

a connecting unit mounted on the barrel and connected between the top cover and the cylinder;

an operation unit mounted on the top cover and connected with the piston; and a delivery unit mounted on the top cover and connected to the barrel;

wherein the barrel has an interior provided with a receiving chamber;

the top cover has an interior provided with a flow channel and has a central portion provided with a shaft hole connected between the flow channel and the cylinder;

the flow channel of the top cover has an upper portion provided with a drain hole connected to an ambient environment through the top cover;

the flow channel of the top cover has a lower portion provided with a first connecting hole connected between the flow channel and the connecting unit and a second connecting hole connected between the flow channel and the receiving chamber of the barrel;

the switching valve is mounted on the flow channel of the top cover and includes:

a valve stem movably mounted in the flow channel of the top cover;

a plurality of gaskets mounted on the valve stem;

a plurality of connecting grooves formed between the gaskets;

the valve stem of the switching valve has an interior provided with a through hole connected between the flow channel of the top cover and the connecting grooves;

the connecting grooves of the switching valve are connected to the drain hole, the first connecting hole and the second connecting hole of the top cover respectively;

the cylinder is received in the receiving chamber of the barrel and has an interior provided with a piston chamber connected between the shaft hole of the top cover and the connecting unit;

the operation unit includes a propeller shaft movably mounted in the piston chamber of the cylinder and connected with the piston to move the piston;

the connecting unit includes:

a tube connected with the cylinder and having a connecting port connected to the piston chamber of the cylinder; and a conduit having a lower end connected to the tube and an upper end connected to the top cover.

2. The pumping device of claim 1, wherein the pumping device further comprises:

a pressure release unit mounted on the top cover and connected to the barrel.

3. The pumping device of claim 1, wherein the pumping device further comprises:

a pressure gauge mounted on the top cover and connected to the barrel.

4. The pumping device of claim 1, wherein the conduit of the connecting unit is connected to the first connecting hole of the top cover.

5. The pumping device of claim 1, wherein when the valve stem of the switching valve is pushed into the flow channel of the top cover, the drain hole of the top cover is connected to the flow channel of the top cover through the connecting grooves and the through hole of the switching valve, and the first connecting hole of the top cover is connected to the second connecting hole of the top cover through the connecting grooves.

6. The pumping device of claim 1, wherein when the valve stem of the switching valve is pulled outward from the flow channel of the top cover, the first connecting hole of the top cover is connected to the drain hole of the top cover through the connecting grooves of the switching valve, and the second connecting hole of the top cover is connected to the flow channel of the top cover through the connecting grooves and the through hole of the switching valve.

7. The pumping device of claim 1, wherein the tube of the connecting unit is extended through the bottom of the barrel and is connected with the bottom of the cylinder.

8. The pumping device of claim 1, wherein the conduit of the connecting unit is located outside of the barrel and is connected to the first connecting hole of the top cover.

* * * * *